United States Patent [19]

Kenyon, S. Wayne et al.

[11] 4,394,630

[45] Jul. 19, 1983

[54] COMPENSATED DIRECTIONAL COUPLER

[75] Inventors: Kenyon, S. Wayne, Manlius; Bernard H. Geyer, Jr., Liverpool; Conrad E. Nelson, Camillus, all of N.Y.

[73] Assignee: General Electric Company, Syracuse, N.Y.

[21] Appl. No.: 306,519

[22] Filed: Sep. 28, 1981

[51] Int. Cl.[3] ..... H01P 5/18

[52] U.S. Cl. ..... 333/116; 333/238

[58] Field of Search ..... 333/116, 238, 246

[56] References Cited

U.S. PATENT DOCUMENTS

| | | | |
|---|---|---|---|
| 3,480,884 | 11/1969 | Metcalf | 333/116 |
| 3,508,170 | 4/1970 | Poulter . | |
| 3,621,478 | 11/1971 | Johnson et al. | 333/116 |
| 3,629,733 | 12/1971 | Podell . | |
| 3,980,972 | 9/1976 | Podell et al. . | |
| 4,027,254 | 5/1977 | Gunton et al. . | |
| 4,139,827 | 2/1979 | Russell | 333/116 |
| 4,178,568 | 12/1979 | Gunton | 333/116 |

FOREIGN PATENT DOCUMENTS

| | | | |
|---|---|---|---|
| 559318 | 9/1977 | U.S.S.R. | 333/116 |

OTHER PUBLICATIONS

Cohn, S. B., "Shielded Coupled-Strip Transmission Line", *IRE Transactions—Microwave Theory and Techniques,* Oct. 1955, pp. 29-38.

Jones, E. M. T. et al., "Coupled-Strip-Transmission--Line Filters and Directional Couplers", *IRE Transaction on Microwave Theory and Techniques,* Apr. 1956, pp. 75-81.

Podell, A., "A High Directivity Microstrip Coupler Technique", *G-MTT 1970 International Microwave Symposium,* Digest of Technical Papers, IEEE Cat. No. 70C 10-MTT, pp. 33-36.

Shelton, Jr., J. P., "Impedances of Offset Parallel-Coupled Strip Transmission Lines", *IEEE Transactions on Microwave Theory and Techniques,* vol. MTT-14, No. 1, Jan. 1966, pp. 7-15, with correction at p. 249 of MTT-14, May 1966.

deRonde, F. C., "Wide-Band High Directivity in MIC Proximity Couplers by Planar Means", IEEE MTT Digest of the International Microwave Symposium, Washington, D.C., May 1980, p. 480.

Rigg, P. R. et al., "Three Line Broadband Co-directional Microwave Couplers Using Planar Comb and Herringbone Microstrip Lines", IEE Proc., vol. 127, Pt. H, No. 6, Dec. 1980, pp. 315-322.

*Primary Examiner*—Paul L. Gensler

*Attorney, Agent, or Firm*—Carl W. Baker; Richard V. Lang

[57] ABSTRACT

Transmission line directional coupler directivity is improved by providing compensation for even and odd mode phase velocity differences. Teeth are added to the edges of the coupler electrodes remote from the coupling region separating the electrodes, so that the phase velocity of even mode and odd mode waves is made similar over a wide frequency band. The compensation approach is applicable to both suspended substrate and stripline type directional couplers, where the uncompensated odd mode velocity is less than the even mode velocity.

21 Claims, 11 Drawing Figures

COMPENSATED DIRECTIONAL COUPLER

BACKGROUND OF THE INVENTION

1. Field of the Invention

This invention relates to directional transmission line couplers, and more particularly, to a compensated directional coupler for improved directivity of the suspended substrate or stripline type.

2. Description of Prior Art

Directional couplers have been used in transmission lines and in microwave receivers and in power sources for communications and radar in the forms known as "stripline", "suspended substrate" and "microstrip". In general, the type of coupler under consideration relies on "even" and "odd" modes (waves) of energy propagation. With the proper even and odd mode impedances, the coupler maintains an impedance match and a high directivity over a broad bandwidth when the even and odd mode velocities are identical. If the even and odd mode velocities are not identical then the coupler performance is poor. Unequal mode velocities can be due to: (1) using transmission line types that utilize only partially filled dielectric configurations (e.g., microstrip and suspended substrate) and (2) an anisotropic dielectric (i.e., a dielectric with a dielectric constant dependent upon the direction of the RF electric fields). In either case the even and odd mode electric fields "see" different effective dielectric constants and hence different effective mode velocities. It is necessary to compensate for this difference in wave velocity if directivity and an impedance match are to be maintained over a large frequency range.

A number of attempts have been made in the past to overcome this problem of phase velocity difference. One technique for overcoming the problem is the use of lumped capacitances. This technique has the disadvantage of limiting bandwidth of the coupler.

Other techniques, that may be broadband, have been developed for the case where the even mode velocity is less than the odd mode velocity (i.e., $v_e < v_o$). Microstrip is a type of transmission line that results in $v_e < v_o$. The techniques disclosed in U.S. Pat. No. 3,629,733 issued Dec. 21, 1971 to Podell; U.S. Pat. No. 3,980,972 issued Sept. 14, 1976 to Podell et al; and U.S. Pat. No. 4,027,254 issued May 31, 1977 to Gunton et al are for the microstrip case with $v_e < v_o$. The Podell and Podell et al patents describe a coupler having two conductors printed on the surface of a dielectric substrate having periodically indented confronting edges positioned with respect to each other so that the spacing between the confronting edges of the conductors remains uniform. The even mode conductors are at the same RF potential and the even mode velocity is not appreciably altered by the indentations. However, the odd mode is greatly altered by the indentations since it effectively travels along the gap and "sees" a longer effective length (or equivalently a smaller velocity). Thus the velocity difference has been compensated. The Gunton et al patent utilizes coupled fingers to compensate for the unequal mode velocities.

The technique disclosed in U.S. Pat. No. 3,508,170 issued Apr. 21, 1970 to Poulter is to compensate for "end effects". The original main coupled region is composed of straight conductors in air (with equal mode velocities). The end conductors are curved and produce a variable coupling or mismatch. The compensation alters the main line mode velocities in order to correct for the errors at each end.

Another technique is disclosed in U.S. Pat. No. 4,178,568 issued Dec. 11, 1979 to Gunton. This patent utilizes a long coupler with a variable coupling to achieve a large bandwidth with warped modes.

SUMMARY OF THE INVENTION

An object of the instant invention is to provide wide band compensation of transmission line directional couplers to maintain good directivity over a wide frequency band.

A further object of the instant invention is to provide a quarter wavelength directional coupler with wide band compensation.

A more specific object of the instant invention is to provide such a compensated coupler which has a wide band impedance match and a high wide band directivity, when the characteristics of the coupler are such that the even mode velocity exceeds the odd mode velocity.

Accordingly, the instant invention comprises a compensated coupler in which a pair of electrodes is deposited on the major surface of an insulating substrate, and aligned to define a coupling region between the adjacent edges thereof. Each of the electrodes comprises a bus bar extending in a generally longitudinal direction. Attached to the outer edges of each of the bus bars, respectively, is a plurality of teeth extending generally transversely of the bus bar in the direction away from the coupling region.

BRIEF DESCRIPTION OF THE DRAWINGS

The features of the invention believed to be novel and unobvious over the prior art are set forth with particularity in the appended claims. The organization, method of operation and advantages of the pressent invention, may best be understood by reference to the following description taken in conjunction with the accompanying drawings in which like reference characters refer to like elements of the invention, and in which:

DESCRIPTION OF THE PREFERRED EMBODIMENTS

Figure 1:
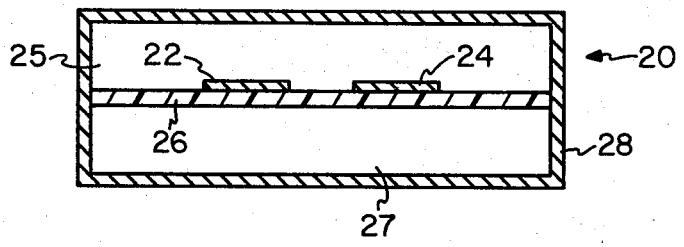
FIG. 1 is a schematic partial cross-sectional view of a directional coupler.

FIG. 1 illustrates the structure of a suspended substrate directional coupler. The coupler 20 consists of two conductors 22, 24 mounted on the dielectric substrate 26 and surrounded by a hollow tubular conductor 28. The conductors 22, 24 are separated from the walls of conductor 28 by spaces 25, 27 which may be filled with air or other dielectric material.

Figure 2:
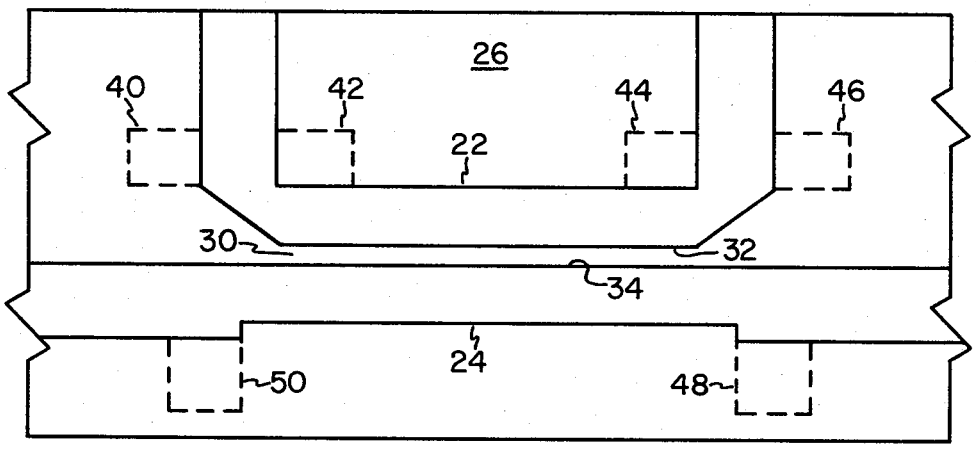
FIG. 2 PRIOR ART
FIG. 2 is a schematic partial plan view of a standard directional coupler.
Figure 3:
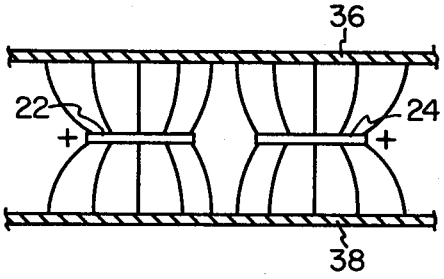
FIG. 3 is a schematic view showing the conventional even mode electric field pattern for the directional coupler of FIG. 2.
Figure 4:
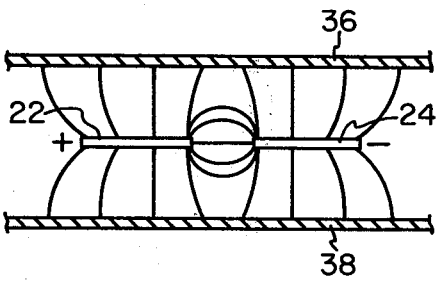
FIG. 4 is a schematic view showing the conventional odd mode electric field pattern for the directional coupler of FIG. 2.

A conventional coupler as shown in FIG. 2 exhibits the electric field pattern illustrated in FIG. 3 for the even mode, i.e., both conductors 22 and 24 at potentials of equal magnitude and polarity, as shown by the plus signs (+), relative to the ground planes 36, 38 of the conductor 28 and carrying equal currents in the same direction. Coupler 20 exhibits the electric field pattern illustrated in FIG. 4 for the odd mode, i.e., conductors 22 and 24 at potentials of equal magnitude but opposite polarity carrying equal currents in opposite directions. Each signal carried by the coupler can be considered to include a component wave traveling in the even mode and a component wave traveling in the odd mode. The wave velocity for each mode is defined by the equation $$V_i = 1/\sqrt{\mu\epsilon_i}$$

in which i represents the even or odd mode, $\epsilon_i$ equals the effective dielectric constant for the even or odd mode, and $\mu$ represents the effective magnetic permability. Because the dielectric properties of substrate 26 differ from those of the regions 25, 27 and the electric field pattern for the odd mode differs from that of the even mode, the even mode velocity, $v_e$, will be greater than the odd mode velocity, $v_o$. In terms of electrical length $\theta_{odd}$ is greater than $\theta$even where $$\theta = 2\pi fl/V_i$$

in which f is the wave frequency, l is the coupler physical length, and $V_i$ is the wave velocity defined above. In order to maintain directivity over a wide frequency band, compensation for this difference in electrical length must be provided. One technique for compensation is illustrated in the dashed line areas of FIG. 2. The conductors could be extended to produce capacitive pads 40, 42, 44, 46 and 48 and 50 which produce a narrowband compensation. However, since the compensation is outside the coupled region and separated by approximately one quarter wavelength, this compensation technique is limited to a narrow frequency band.

Figure 5:
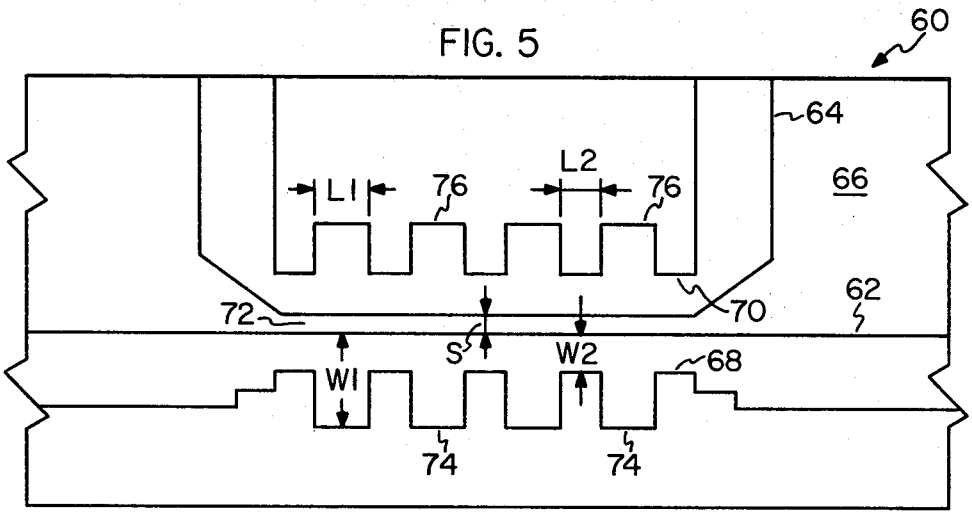
FIG. 5 is a schematic plan view of a coupler employing the compensation technique of the present invention.
Figure 6:
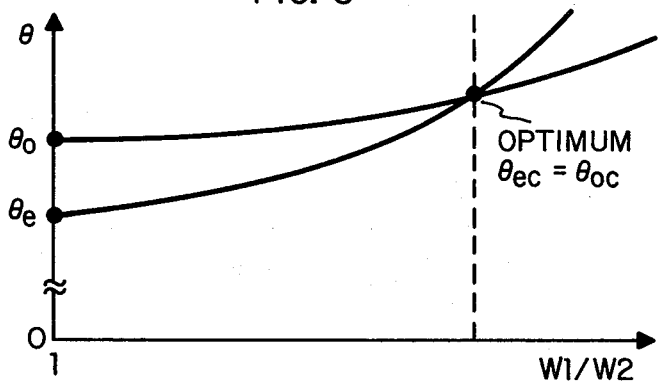
FIG. 6 is a graph of even and odd mode electrical length versus the dimensional relationship of the coupler shown in FIG. 5.

A coupler construction for achieving compensation according to the instant invention is shown in FIG. 5. The coupler 60 includes a pair of elongated conductors 62, 64 mounted upon the dielectric substrate 66 and also includes a pair of parallel bus bars 68, 70 separated by a coupling region 72. Attached to the edge of each of said bus bars remote from said coupling region 72 is a plurality of uniformly shaped and uniformly spaced teeth 74, 76. The dimensions and spacing of the teeth determine the compensation achieved for a particular coupler configuration. In the embodiment shown in FIG. 5, in which L1 equals the tooth length, L2 equals the tooth separation, W1 equals the conductor width including the tooth, and W2 equals the bus bar widths, for a given ratio of tooth spacing, L1/L2, an optimum ratio of conductor widths, W1/W2, exists that compensates the coupler for different mode phase velocities. Any of the dimensions, L1, L2, W1 or W2 can be adjusted to provide the required effective or equivalent even and odd more characteristic impedances and to compensate for phase velocity differences in a particularly frequency range. As shown in FIG. 6, an optimum dimensional relationship between $W_1$ and $W_2$ exists in which the electrical lengths for both odd and even mode are identical. For a given frequency this relationship can be determined and the tooth configuration, tooth spacing and tooth dimensions can be selected to provide the necessary compensation for that frequency. Because the compensation is of a distributed nature, i.e., the impedance variation for each conductor is distributed along the full coupling length of the conductors, the compensated coupler of the present invention can achieve a wide band impedance match and a high wide band directivity in a quarter wavelength coupler.

Figure 7:
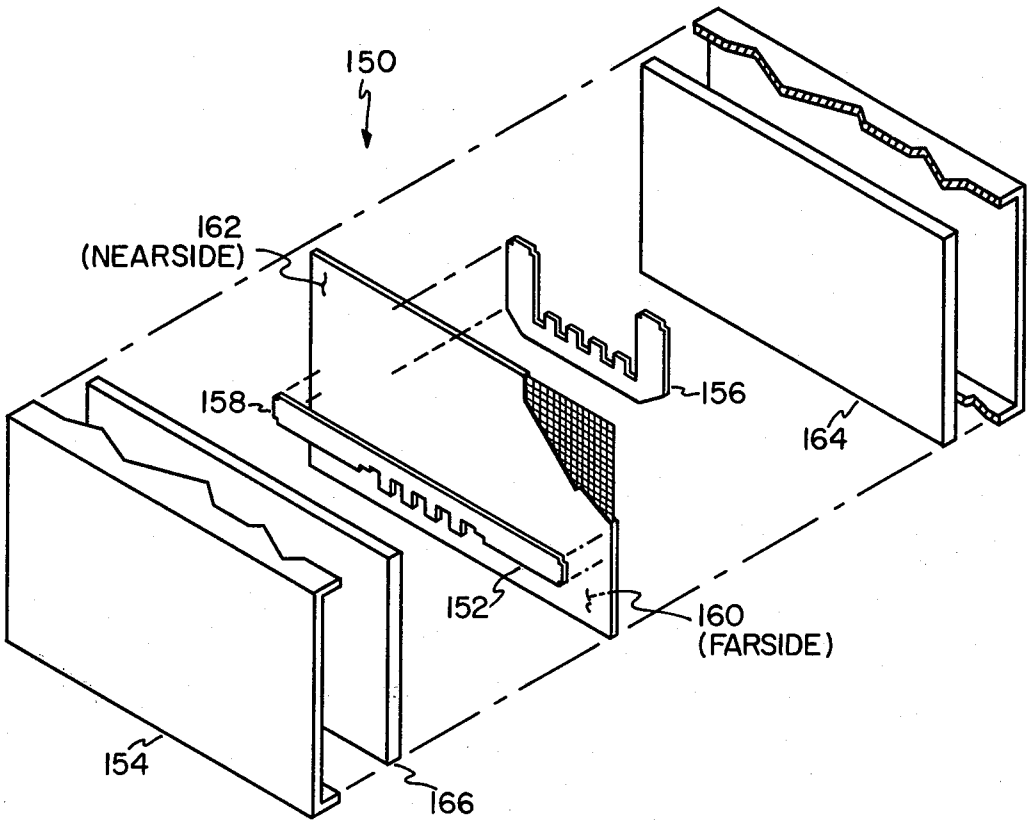
FIG. 7 is a schematic partial view showing the elements of an embodiment of the present invention in exploded arrangement.
Figure 8:
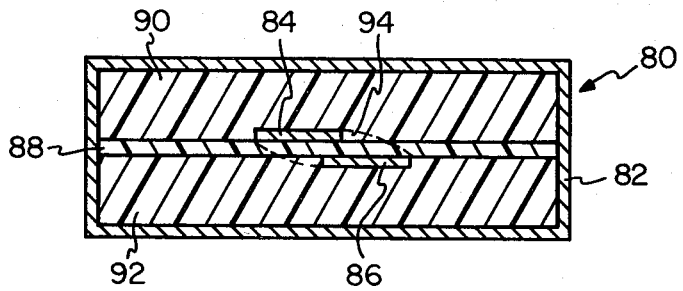
FIG. 8 is a schematic partial cross-sectional view of another embodiment of the present invention.

Another embodiment of the present invention is shown in exploded fashion in FIG. 7. A dielectric substrate 152 is supported in a hollow rectangular conductor 154, and the bus bars 156, 158 for the coupler 150 are disposed, respectively, on the opposite major faces 160, 162 of the dielectric substrate. Between the hollow conductor 154 and substrate 152 are disposed layers 164, 166 of insulating material to fill the spaces above and below the substrate. In this configuration the odd mode wave sees the dielectric constant of the dielectric materials of the substrate 152 and the two dielectric layers 164, 166. The dielectric substrate 152 may have a thickness in the range of 0.025 inch and each of the dielectric layers 164,166 may have a thickness in the range of 0.125 inch.

The coupler of the present invention may have a cross section such as shown in any of FIGS. 8, 9, 10 or 11 as well as the cross section shown in FIG. 1. The coupler 80 shown in FIG. 8 includes a hollow conductor 82, a pair of electrodes 84, 86 mounted on opposite sides of insulating substrate 88 and a pair of fillers 90, 92 made of the same insulating material. Coupling region 94 includes the portion of substrate 88 between electrodes 84, 86 and portions of fillers 90, 92 in close proximity to electrodes 84, 86. In this coupler 80 the difference in even mode and odd mode wave velocities is due to the difference in dielectric constant, $\epsilon$, of the substrate 88 and the dielectric constant $\epsilon_2$ of the fillers 90, 92 and the difference in the dielectric constant of substrate 88 in the horizontal plane $\epsilon_1$ as viewed in FIG. 8 from its dielectric constant $\epsilon_3$ in the vertical direction. The distributed compensation pattern shown in FIG. 5 can be employed on electrodes 84, 86 to compensate for these differences in electrical properties.

Figure 9:
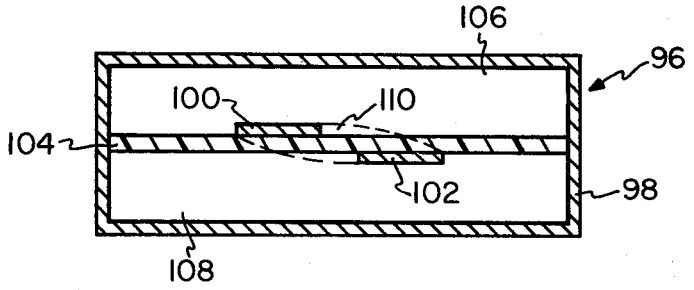
FIG. 9 is a schematic partial cross-sectional view of an alternative embodiment of the present invention.

The coupler 96, FIG. 9, includes hollow conductor 98, electrodes 100, 102 mounted on substrate 104 and spaces 106, 108 filled with air or other insulating material. Due to the greater horizontal separation of electrodes 100 and 102 coupling region 110 is larger than coupling region 94 of coupler 80 shown in FIG. 8. The difference in wave velocity for coupler 96 will be different from that for coupler 80 due to the different electrical properties of coupler 96, including the difference between the dielectric constant of air and the substrate 104. Again, the distributed teeth, as shown in FIG. 5, are applied to the electrodes 100, 102 to provide the necessary compensation.

Figure 10:
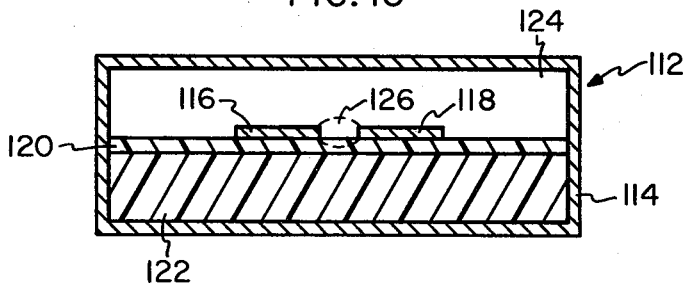
FIG. 10 is a schematic partial cross-sectional view of another alternative embodiment of the present invention.

Coupler 112, FIG. 10, includes hollow conductor 114, electrodes 116, 118 mounted on substrate 120, and a filler 122 of insulating material. Space 124 is not filled and therefore is usually filled with air. Here, substrate 120 has a dielectric constant $\epsilon_1$ in the horizontal plane and a different dielectric constant $\epsilon_3$ in the vertical direction. Filler 122 has a dielectric constant $\epsilon_2$ different from $\epsilon_1$ or $\epsilon_3$, and the air or other gaseous filler of space 124 has yet another dielectric constant $\epsilon_4$. Each of these dielectric constants affects the overall properties of the coupling region 126.

Figure 11:
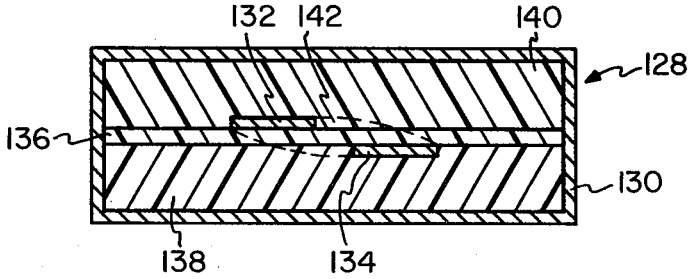
FIG. 11 is a schematic partial cross-sectional view of yet another embodiment of the present invention.

Coupler 128, FIG. 11, includes hollow conductor 130 electrodes 132, 134 mounted on substrate 136, insulating filler 138 having a dielectric constant $\epsilon_5$. The two dielectric constants $\epsilon_1$, $\epsilon_3$ of the substrate respectively in the horizontal and vertical dimensions thereof, along with constants $\epsilon_2$ and $\epsilon_5$ of the respective fillers 138, 140 determine the electrical properties of coupling region 142. The configurations of FIGS. 1, 8, 9, 10 and 11 are exemplary only and other variations may be employed which would produce the wave velocity differences $v_e > v_o$. The present invention provides a technique for compensation of all such configurations, in a simple effective construction which does not require an increase in coupler size.

The substrates and fillers described above may be anisotropic insulating substrates, which have one dielectric constant in the plane of the substrate and a different dielectric constant in a direction perpendicular to the plane of the substrate. This anisotropy contributes to the effective electrical length for even and odd mode waves passing along the conductors. In forming the substrate, a woven mesh of an insulating material, such as glass fiber, may be embedded in a suitable insulating material such as polytetrafluorethylene. This construction produces physical and electrical characteristics in the plane of the substrate in which the fibers run different from the characteristics of the material in a plane normal to the plane of the substrate. An alternative method of making the anisotropic substrate is to form a slurry including fibers of insulating material, such as glass, in a base of insulating material, such as polytetrafluoroethylene, in a combination such that the fibers form 5% to 10% of the total volume of the substrate. In compressing the slurry to a thin sheet, the fibers tend to be bent or aligned into the plane of the substrate producing a difference in physical and electrical properties similar to that exhibited by the substrate incorporating the woven mesh.

The fillers, for example 138, 140 of FIG. 11, may be made similarly to the substrate of fibers embedded within a mass of insulating material, or may be made of a mass of insulating material such as polytetrafluoroethylene without a fiber material, or may be of any other suitable dielectric material, such as glass. If desired the coupler may be enclosed so that gases other than air could be used in the spaces such as 106, 108 of FIG. 9 or 124 of FIG. 10.

We claim:

1. A directional coupler comprising:

a dielectric substrate having two major parallel opposing faces;

a pair of spaced elongate electrodes disposed on one major face of said substrate and defining a coupling region therebetween extending along at least a part of their respective lengths; each of said electrodes comprising a comb electrode comprising an elongate bus bar extending in a generally longitudinal direction and a plurality of spaced teeth attached to said bus bar in the area of said coupling region and extending generally transverse to said bus bar in the direction away from the other of said electrodes; and a conductor supporting said substrate.

2. The invention of claim 1 wherein:

said dielectric substrate has a larger dielectric constant in the plane generally parallel to said major faces than in a plane generally perpendicular to said major faces.

3. The invention of claim 1 wherein:

said electrodes are disposed upon said substrate such that said teeth of one of said pair of electrodes are generally aligned longitudinally with said teeth of said other of said pair of electrodes.

4. The invention of claim 1 wherein:

said teeth of each of said electrodes are longitudinally uniformly spaced; and said electrodes are disposed upon said substrate such that each of the teeth of one of said pair of electrodes is aligned longitudinally with a respective one of the teeth of the other of said pair of electrodes.

5. The invention of claim 4 wherein:

each of said teeth comprises a rectangular conductive member extending generally perpendicular to the axis of said bus bar and having an end surface parallel with one longitudinal edge of said bus bar.

6. A directional coupler comprising:

a dielectric substrate having two major parallel opposing surfaces;

a first elongate electrode disposed on one of said major surfaces and a second elongate electrode disposed on the other of said major surfaces each of said electrodes comprising an elongated bus bar and a plurality of teeth extending generally perpendicular to said bus bar attached to the edge of said bus bar remote from the other of said electrodes;

said electrodes being disposed in a generally parallel longitudinal direction such that said electrodes are magnetically coupled to one another along a generally longitudinally extending coupling region extending at least a part of their respective lengths; and a generally rectangular hollow conductor supporting said substrate at opposed edges thereof and having generally flat sides spaced from each respective major surface of said substrate.

7. The invention of claim 6 wherein said dielectric substrate comprises:

a sheet of material having a first dielectric constant in the plane of said sheet and a second dielectric constant in a direction generally normal to said plane of said sheet.

8. The invention of claim 7 further comprising:

a first volume of insulating material filling the space between a first one of said major surfaces of said substrate and a respective one of said sides of said hollow rectangular conductor; and a second volume of insulating material filling the space between the second one of said major surfaces of said substrate and the respective other of said sides of said hollow rectangular conductor.

9. The invention of claim 8 wherein each of said volumes of insulating material comprises a volume of dielectric material having a dielectric constant distinct from said first or second dielectric constant of said dielectric substrate.

10. The invention of claim 8 wherein:

said first volume of insulating material comprises air; and said second volume of insulating material comprises a solid dielectric.

11. The invention of claim 8 wherein:

said first volume of insulating material comprises a solid dielectric material having a third dielectric constant different from said first or second dielectric constant of said dielectric substrate; and said second volume of insulating material comprises a solid dielectric material having a fourth dielectric constant different from any of said first, second or third dielectric constant.

12. The invention of claim 11 wherein said first dielectric constant of said substrate is greater than said second dielectric constant of said substrate.

13. The invention of claim 12 wherein said substrate comprises a woven glass fiber mesh embedded within a filler of polytetrafluororethylene.

14. The invention of claim 9 wherein:

said substrate comprises a glass fiber mesh embedded within a filler of polytetrafluoroethylene; and each of said volumes of insulating material comprises a solid block of polytetrafluoroethylene.

15. The invention of claim 9 wherein:

said substrate comprises a mass of glass fibers embedded within a filler of polytetrafluoroethylene; and each of said volumes of insulating material comprises a solid block of glass.

16. The invention of claim 9 wherein:

a pair of layers of insulating material are disposed within said hollow rectangular conductor and adjacent said substrate and electrodes and sandwiching said substrate; each of said pair of layers being bonded to a respective one of the major surfaces of said first insulating layer.

17. The invention of claim 16 wherein:

said substrate has a thickness in the range of 0.025 inch; and each of said pair of layers of insulating material has a thickness in the range of 0.125 inch.

18. The invention of claim 9 wherein:

said substrate comprises a mass of glass fibers embedded within a body of polytetrafluorothylene; said glass fibers comprising by volume about 5 to 10 percent of the total volume of the substrate.

19. The invention of claim 18 wherein:

a pair of solid fillers of glass is disposed within said hollow rectangular conductor; each of said pair being disposed adjacent one of said major surfaces of said substrate and filling the space between one of said major surfaces and a respective side of said hollow rectangular conductor.

20. The invention of claim 18 wherein:

a pair of solid fillers is disposed within said hollow rectangular conductor; each of said pair of solid fillers being disposed adjacent one of said major surfaces of said substrate and filling the space between one of said major surfaces and a respective side of said hollow rectangular conductor; and each of said pair of solid fillers comprises a mass of glass fibers embedded within a body of polytetrafluoroethylene; said glass fibers comprising by volume about 5 to 10 percent of the total volume of the solid fillers.

21. The invention of claim 18 wherein:

a pair of solid fillers is disposed within said hollow rectangular conductor; each of said pair of solid fillers being disposed adjacent one of said major surfaces of said substrate and filling the space between one of said major surfaces and a respective side of said hollow rectangular conductor; and each of said pair of solid fillers comprises a woven glass fiber mesh embedded within a body of polytetrafluoroethylene.

* * * * *